US006504926B1

(12) United States Patent
Edelson et al.

(10) Patent No.: US 6,504,926 B1
(45) Date of Patent: Jan. 7, 2003

(54) USER CONTROL SYSTEM FOR INTERNET PHONE QUALITY

(75) Inventors: Steven D. Edelson, Wayland, MA (US); Ede Phang Ng, Singapore (SG)

(73) Assignee: MediaRing.com Ltd. (SI)

( * ) Notice: Subject to any disclaimer, the term of this patent is extended or adjusted under 35 U.S.C. 154(b) by 0 days.

(21) Appl. No.: 09/210,601

(22) Filed: Dec. 15, 1998

(51) Int. Cl.[7] ..... H04R 3/00
(52) U.S. Cl. ..... 379/390.01; 379/395
(58) Field of Search ..... 381/111; 379/900, 379/390.01, 395

(56) References Cited

U.S. PATENT DOCUMENTS

| | | | | |
|---|---|---|---|---|
| 2,267,876 A | | 12/1941 | Schmidt | |
| 4,371,750 A | | 2/1983 | Markley | |
| 5,347,646 A | | 9/1994 | Hirosawa et al. | |
| 5,365,579 A | | 11/1994 | Henderickson | |
| 5,386,478 A | | 1/1995 | Plunkett | |
| 5,452,289 A | | 9/1995 | Sharma et al. | 370/32.1 |
| 5,471,470 A | | 11/1995 | Sharma et al. | 370/81 |
| 5,589,818 A | * | 12/1996 | Queen | 340/506 |
| 5,600,649 A | | 2/1997 | Sharma et al. | 370/435 |
| 5,629,687 A | * | 5/1997 | Sutton et al. | 379/37 |
| 5,675,656 A | * | 10/1997 | Sondermeyer et al. | 381/100 |
| 5,715,319 A | | 2/1998 | Chu | |
| 5,760,824 A | | 6/1998 | Hicks, III | |
| 5,764,512 A | | 6/1998 | Michel et al. | |
| 5,764,627 A | | 6/1998 | Sharma et al. | 370/271 |
| 5,764,757 A | | 6/1998 | Christinger | |
| 5,778,082 A | | 7/1998 | Chu et al. | |
| 5,872,922 A | * | 2/1999 | Hogan et al. | 709/204 |
| 5,949,412 A | * | 9/1999 | Huntsman | 345/740 |
| 6,009,469 A | * | 12/1999 | Mattaway et al. | 709/227 |

FOREIGN PATENT DOCUMENTS

JP 11215133 A * 8/1999 ..... G06F/3/16

OTHER PUBLICATIONS

Renault, Renault 16 Driving and Maintenance (supplement to NE 945), Sep. 1966.*

Kenwood, TS–570S/D Instruction Manual, Apr. 1998, pp. 71–72.*

Wolfgang, Larry, Kenwood TS–570D HF Transceiver, QST Magazine, Jan. 1997, pp 73–77.*

PCT Published Application No. WO 98/18238, 1998.

* cited by examiner

*Primary Examiner*—Forester W. Isen
*Assistant Examiner*—Daniel Swerdlow
(74) *Attorney, Agent, or Firm*—Fenwick & West LLP

(57) ABSTRACT

In an Internet telephony system, personal computers are interconnected by means of the Internet to transmit and receive voice sounds detected by microphones connected to the personal computers. Each personal computer is provided with a capability to adjust the sensitivity of the microphone at the remote personal computer. By means of the same control, each personal computer can also adjust the gain of the local speaker.

20 Claims, 2 Drawing Sheets

USER CONTROL SYSTEM FOR INTERNET PHONE QUALITY

This invention relates to remote voice communication and more particularly to a system for improving the quality of voice reproduction in an Internet telephony system.

BACKGROUND OF THE INVENTION

An Internet telephone, using a personal computer typically utilizes a microphone and speaker connected with the personal computer. The personal computer (PC) digitizes the microphone signal, compresses this data and sends it over an Internet connection (LAN, WAN or modem) to a receiving device (typically another PC). The receiving PC decompresses the data and converts the digital data to an audio signal to drive a speaker or headphones. This process occurs in both directions simultaneously.

There are other PC functions involved in Internet telephony including establishing the connection, error detection and recovery, removing echo and speaker feedback, but these functions are not part of this invention.

The microphone and speaker interface to the normal PC sound subsystem or sound board, which is also used for playing music, error beeps, recording notes, game effects, speech recognition, etc. As a general-purpose sound subsystem, it has computer controls to adjust the microphone sensitivity and speaker output gain.

Since the sound subsystem employs analog-to-digital converters (ADC), which have a limited dynamic range, it is important to adjust the microphone audio output to the proper range. This adjustment is more critical than normal since the voice compression algorithms, which compress the digital data representing the audio voice signal, work to model the human speech and tend to reject or mis-code sounds that are not speech-like (such as instrumental music).

If the microphone is too sensitive, then the waveforms will be severely clipped and distorted. The compression algorithm will exacerbate this distortion. If the microphone is too insensitive, then the voice will be confused with background noise and quality will again be poor and can be even silenced by automatic squelch functions.

For these reasons, proper adjustment of the microphone is critical to the voice quality. Automatic gain control (AGC) circuits are often used, but with mixed results. Long periods of silence of a conversation tend to frustrate an AGC. A proper manual setting of the microphone sensitivity is usually superior.

The normal user control for microphone sensitivity is software driven. As the user moves an on-screen control with the mouse or keyboard, an indicator shows the resulting level on a simulated Vu meter, or simulated LED Bar-graph or numerically or any of a number of user interfaces. The adjuster tries to speak and observe the level as he adjusts ("testing, 1, 2, 3 . . . ").

But it turns out that the best adjustment is not to see a magnitude level, but to hear the result through the compressor, transmission, de-compressor chain. This presents a problem since the person talking is in the wrong place. He is at the source, not destination. If the audio is looped back, other problems are presented. The person talking cannot properly hear his own voice, new errors are introduced by the dual end-to-end transmission, and the time delay between speaking and hearing (typically greater than 0.3 seconds) is confusing.

The person on the far end of the connection is in the best audio sensing position to adjust this microphone sensitivity since he can hear the results of the adjustment without interference. This can be done by telling the person talking to turn up the microphone sensitivity a little or down a little or move closer to the microphone, etc. until a good result is achieved. However, this technique can be tiresome, and annoying to both parties.

SUMMARY OF THE INVENTION

In accordance with the invention, the above described problems are solved by providing the PC's in the Internet telephone system with the capability to adjust the microphone sensitivity at the remote PC. Each PC is provided with a facility to respond up and down input adjustments of the user to transmit control signals to the remote PC, where the corresponding facility at the remote PC will respond to the received control signals to adjust the microphone sensitivity at the remote PC via the sound subsystem. In operation, a party to an Internet telephone connection listens to the voice of the remote user and adjusts the sensitivity of the microphone at the remote PC to provide the best voice reproduction.

In accordance with another embodiment of the invention, the user's remote microphone sensitivity control is adjusted in conjunction with the gain of the speaker at his own PC to achieve optimum results. In one embodiment, a volume control is provided which in one end of its range adjusts the speaker gain, and in the other end of its range adjusts the microphone sensitivity. In another embodiment, the speaker gain and microphone sensitivity are adjusted simultaneously in the same direction. In the third embodiment, the input control adjusts the microphone sensitivity and the speaker gain in opposite directions whereby the control can be used to adjust quality of the voice reproduction without adjusting the volume.

DESCRIPTION OF A PREFERRED EMBODIMENT

Figure 1:
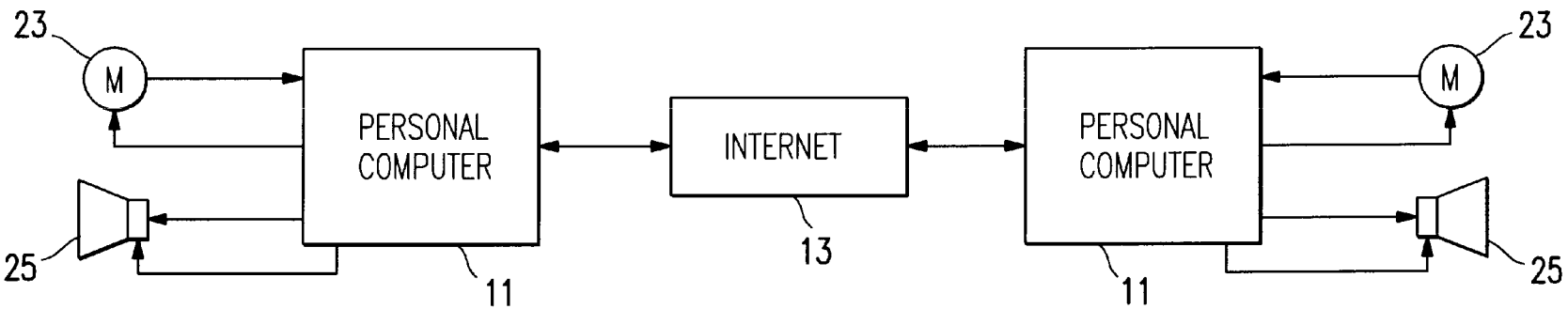
FIG. 1 is a block diagram representing two parties connected for Internet telephony.
Figure 2:
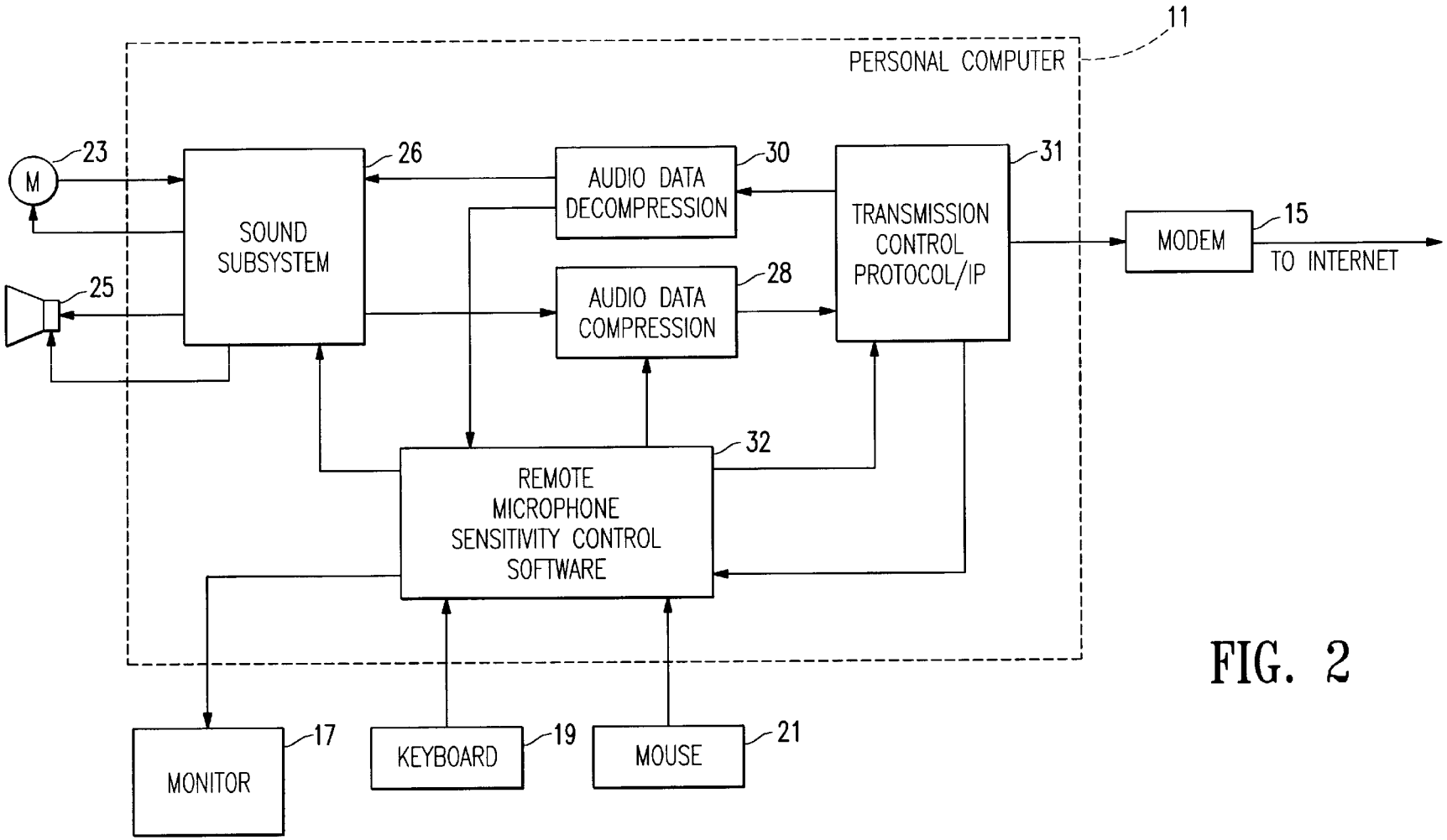
FIG. 2 is a block diagram illustrating the PC and associated components at one Internet site employing the system of the invention.

As shown in FIG. 1, the Internet telephony system in which the invention is employed comprises data processors in the form of personal computers 11 (PC's) which can transmit data back and forth to each other and to other PC's via the Internet 13. As shown in FIG. 2, data is transmitted to the Internet and received from the Internet via modems 15 which convert the data signals to a form for transmission over telephone lines. Each personal computer is provided with a monitor 17 for displaying information including control menus and control buttons. Each PC is provided with input controls in the form of a keyboard 19 and a mouse 21, which interacts with control buttons displayed on the screen to control the operation of the PC and the PC software via the PC operating system. In addition, each personal computer is provided with a microphone 23 with an adjustable sensitivity and an audio speaker 25 with an adjustable gain. Each PC is also provided with a sound subsystem 26 which has the capability of receiving the audio signals from the microphone 23 and converting the signals into digital data representing the voice sound detected by the microphone 23. In addition, the sound subsystem 26 converts digital signals representing audio signals into analog audio signals and applies these analog audio signals to the speaker 25 to reproduce the voice sound represented by the digital audio signals. The sound subsystem 26 is provided with the capability to control the sensitivity of the microphone 23 and either increase or decrease its sensitivity incrementally in response to input control signals received from the personal computer operating system. The sound system 26 also has a capability to adjust the output gain of the speaker 25 in a similar manner. When the PC's 11 are used in an Internet telephone call, two PC's 11 will be interconnected to transmit and receive data from each other simultaneously over the Internet 13. Voice sound picked up by the microphone 26 is converted to a digital signal by the sound subsystem 26. The digital signals produced by the sound subsystem 26 are compressed by data compression software 28 and then presented to the transmission control protocol IP software 31 (TCP/IP) as compressed audio data packets. The TCP/IP organizes the received data into transmission data packets with headers to indicate the IP address to which the transmission data packets are to be sent. The transmission data packets are transmitted over the Internet 13 by means of the modem 15. The transmission data packets containing the compressed audio data are received by the remote PC 11 via the modem 15 and the TCP/IP 31 at the remote PC. Decompression software 30 at the remote PC receives the compressed audio data from the TCP/IP, decompresses the digital audio data, and applies it to the sound subsystem 26, which converts the decompressed digital signals to an analog signal and applies the analog signal to the speaker 25 at the other personal computer. In this manner, the voice sound picked up by the microphone 23 at one PC 11 is reproduced by the speaker at the other remote PC 11. The remote PC 11 transmits voice sound received by its microphone 23 to be reproduced by the speaker 25 at the first PC in the same manner and the process of transmitting and receiving the voice sound and reproducing the voice sound at each personal computer goes on simultaneously so that an Internet telephone conversation can take place.

In accordance with the invention, each personal computer is provided with the capability of adjusting the microphone sensitivity at the other personal computer to which it is connected by the Internet telephone connection. For this purpose, each personal computer is provided with remote microphone sensitivity control software 32 which will respond to input signals from the keyboard 19 or the mouse 21. The remote sensitivity control software 32 at the proximal personal computer recognizes an input signal from either the keyboard 19 or the mouse 21 to increase or decrease the sensitivity of the microphone at the remote personal computer on the Internet telephone connection and, in response to such input signals, generates an output message to represent an incremental increase or decrease in the sensitivity of the microphone at the remote PC. Alternatively, the message could be an indication of a specific sensitivity level in the range of sensitivity adjustment of the remote microphone or it could be a value indicating a degree of change to be made in the sensitivity of the remote microphone. This message is placed in a message packet and applied to the TCP/IP 31, which puts the message packet in a transmission data packet and sends the message packet to the modem 15 along with the compressed audio data. The data compression software 28 and the remote microphone sensitivity software apply headers to the compressed audio data packets and message packets presented to the TCP/IP to indicate what kind of data is included in the packets and thus indicating that data contains audio data or indicating that the data contains a microphone sensitivity control message. The message calling for a change in the microphone sensitivity can also be presented in a hybrid data packet containing both audio data and microphone sensitivity adjustment messages. The microphone sensitivity adjustment message will be received by the remote PC along with the compressed audio signal data. At the remote PC, the incremental increase or decrease messages will be received by the remote sensitivity control software 32 and the audio data will be received to the decompression software 30. The software 32 at the remote PC in response to the incremental increase or decrease message received from the TCP/IP 31 will apply a corresponding signal to the sound subsystem 26 to control the microphone sensitivity of the microphone 23 at the remote PC in the same manner that signals from the keyboard or mouse 21 at the remote PC control the sensitivity of the microphone 23. In response to a message calling for an incremental increase in the microphone sensitivity, the software 32 will apply a corresponding signal to the sound system 26, which in response thereto will increase the sensitivity of the microphone 23 by an increment. In response to a message calling for an incremental decrease in the microphone sensitivity, the software 32 will apply a corresponding signal to the sound system 26, which in response thereto will decrease the sensitivity of the microphone 23 by one increment. If the microphone sensitivity message calls for a specific microphone sensitivity level or a degree of change in the sensitivity level, the software 32 will control the sound subsystem accordingly to achieve the commanded adjustment in microphone sensitivity. In this manner, a person at one PC in an Internet telephone call to a second remote PC can adjust the sensitivity of the microphone at the remote PC.

The microphone sensitivity software 32 obtains data from the PC operating system indicating the level of sensitivity at which the microphone is currently set in its range between its maximum and minimum sensitivity and presents this data in a message packet with an appropriate header to the TCP/IP. The microphone sensitivity software also obtains from the digital audio data being generated by the sound board a measurement of the audio amplitude. This may be a peak measurement, an amplitude average measurement, and RMS measurement or any other selected amplitude measurement of the audio data. The amplitude measurement will be presented to the TCP/IP in a measurement packet with an appropriate header. The TCP/IP will transmit the sensitivity level data and the amplitude measurement data to the other PC where it will be received by the microphone sensitivity software 32, which will generate displays of these measurements on the monitor 17. These displays may be in the form of a bar graph, simulated Vu meter, numerical indication or any other equivalent graphical or numerical value display.

In operation, a person at one computer adjusts the sensitivity of the microphone at the other computer up or down in response to hearing the speech reproduced from the audio data received from the other computer to provide the best quality voice reproduction to the person listening to the voice reproduction and an optimum voice reproduction is achieved. The user making the adjustment will be assisted by the sensitivity level indicator and the amplitude indication received from the PC at which the microphone sensitivity is being adjusted.

Before making any adjustment to the sensitivity of the remote microphone, the microphone sensitivity software will store the initial sensitivity level of the remote microphone as indicated by a message received from the remote PC. Then, when the voice communication between the two PC's has ended, as indicated, for example, by a voice communication deactivation input, the software 32 will present a message to the TCP/IP to be transmitted back to the other PC to adjust the sensitivity of the remote microphone back to its initial level.

The person hearing the audio and adjusting the sensitivity of the microphone at the remote personal computer can also adjust the gain of his own speaker in conjunction with adjusting the microphone at the remote personal computer. A prior art Internet telephony user can adjust his speaker gain to raise or lower the speaker volume, but this adjustment typically fails to provide satisfactory results because the range of the volume control on the local speaker is insufficient to provide a desired output volume under various conditions. For example, the gain of the local speaker may be adjusted to its maximum value and the resulting volume may still be too soft. The user of the present invention, after adjusting the gain of his local speaker to its maximum may then adjust the sensitivity of the microphone at the remote personal computer to further increase the volume to the desired volume level.

In accordance with other embodiments of the invention, the keyboard or mouse is used as a combined volume control to adjust both the speaker gain and the remote microphone sensitivity. In these embodiments, the remote microphone sensitivity control software 32 also operates to adjust the local speaker gain in combination with adjusting the remote microphone sensitivity in accordance with the predetermined protocol. In one protocol arrangement, the upper end of the volume control range controls the remote microphone sensitivity and the lower end of the volume control range controls the local speaker gain. When operating in the lower end of the range, an adjustment of the range to increase the volume will first increase the gain of the local speaker until it reaches it maximum and then further adjustments calling for additional volume will increase the sensitivity of the remote microphone. Alternatively, the lower end of the range could control the remote microphone sensitivity and the upper end of the range could control the lower speaker gain. In another protocol, the volume adjustment adjusts both the local speaker gain and the remote microphone sensitivity simultaneously in the same direction over the full range of the volume control. Alternatively, the protocol could be a combination of the above two described arrangements, such as, for example, at the lower end of the volume range, only the speaker gain or only the remote microphone sensitivity being adjusted, in the midrange of the volume control, both the speaker and the microphone sensitivity being adjusted simultaneously, and at the upper end of the range calling for the loudest levels, only the microphone sensitivity or the speaker gain being adjusted.

In a third embodiment of the invention, a quality control is provided. The quality control adjusts both the remote microphone sensitivity and the local speaker gain. However, in this embodiment, the adjustments are made in the opposite direction whereby when the volume control is moved to increase the local speaker gain, it decreases the remote microphone sensitivity and vice versa. With this control, the remote microphone sensitivity can be adjusted for quality while maintaining the net volume output from the local speaker approximately constant. In this case, the control, instead of being labeled as a volume control, would be labeled distortion, tone, or quality. The changes in quality are indicated on the screen of the monitor 17 by an appropriately labeled simulated meter bar graph or the like.

The above description is of a preferred embodiment of the invention, and modification may be made thereto without departing from the spirit and scope of the invention which is defined in the appended claims.

What is claimed is:

1. An Internet telephone unit for transmitting and receiving data representing voice signals over an Internet connection comprising a data processor, a microphone having an adjustable sensitivity connected to said data processor, a speaker connected to said data processor, said data processor being operable to convert analog signals generated by said microphone into digital data to be transmitted over said Internet connection and to receive digital data representing sound over said Internet connection, convert the received digital data to an audio signal applied to said speaker to reproduce the sound represented by the received digital data, a remote microphone sensitivity control connected to said data processor operable by a user of said data processor to cause said data processor to generate messages to call for an increase or decrease in the sensitivity of a microphone at a remotely located Internet telephone unit and to transmit said control messages over said Internet connection, said data processor being operable to receive control messages calling for an increase or decrease in the sensitivity of said microphone and to adjust the sensitivity of said microphone in accordance with said control messages.

2. A telephony apparatus capable of adjusting the sensitivity of a remote microphone within a network connection, the apparatus comprising:

a local microphone coupled to the apparatus;

a processor, coupled to the apparatus and to the local microphone, adapted to transmit outgoing microphone control signals on the network connection to adjust the sensitivity of a remote microphone; and the processor further adapted to receive incoming microphone control signals from the network connection and, in response, adjust the sensitivity of the local microphone.

3. The apparatus of claim 2, wherein the network connection is an Internet connection.

4. The apparatus of claim 2, further comprising:

a local speaker coupled to the apparatus and to the processor;

the processor further adapted to transmit outgoing speaker control signals on the network connection to adjust the sensitivity of a remote speaker; and the processor further adapted to receive incoming speaker control signals from the network connection and, in response, adjust the gain of the local speaker.

5. The apparatus of claim 4, wherein the network connection is an Internet connection.

6. The apparatus of claim 4, wherein the incoming microphone control signals and incoming speaker control signals are in the form of an incoming audio control signal.

7. The apparatus of claim 6, wherein the incoming audio control signal adjusts the sensitivity of the local microphone and the gain of the local speaker in the same direction.

8. The apparatus of claim 6, wherein the incoming audio control signal adjusts the sensitivity of the local microphone and the gain of the local speaker in opposite directions.

9. The apparatus of claim 2, further comprising:

a local speaker coupled to the apparatus and to the processor;

the processor further adapted to transmit outgoing speaker control signals on the network connection to adjust the gain of a remote speaker in combination with the outgoing microphone control signals;

the processor further adapted to receive an incoming audio control signal; and the incoming audio control signal comprising incoming speaker control signals from the network connection and the incoming microphone control signals to adjust the gain of the local speaker and the sensitivity of the local microphone in response to the incoming audio control signal.

10. The apparatus of claim 9, wherein the incoming audio control signal adjusts the sensitivity of the local microphone and the gain of the local speaker in the same direction.

11. The apparatus of claim 9, wherein the incoming audio control signal adjusts the sensitivity of the local microphone and the gain of the local speaker in opposite directions.

12. A program storage device readable by a machine, tangibly embodying a program of instructions executable by the machine to perform method steps for adjusting the sensitivity of a remote microphone within a network connection, the method steps comprising:

transmitting outgoing microphone control signals on the network connection to adjust the sensitivity of a remote microphone;

receiving incoming microphone control signals from the network connection; and adjusting the sensitivity of the local microphone in response to the incoming microphone control signals.

13. The program storage device of claim 12, wherein the network connection is an Internet connection.

14. The program storage device of claim 12, the program of instructions executable by the machine to perform further method steps for adjusting the gain of a remote speaker within a network connection, the further method steps comprising: p1 transmitting outgoing speaker control signals on the network connection to adjust the sensitivity of a remote speaker;

receiving incoming speaker control signals from the network connection; and adjusting the gain of the local speaker in response to the incoming speaker control signals.

15. The program storage device of claim 14, wherein the network connection is an Internet connection.

16. The program storage device of claim 14, wherein the incoming microphone control signals and incoming speaker control signals are in the form of an incoming audio control signal.

17. The program storage device of claim 16, the program of instructions executable by the machine to perform further method steps, the further method steps comprising:

receiving the incoming audio control signal; and adjusting the sensitivity of the local microphone and the gain of the local speaker in the same direction in response to the incoming audio control signal.

18. The program storage device of claim 16, the program of instructions executable by the machine to perform further method steps, the further method steps comprising:

receiving the incoming audio control signal; and adjusting the sensitivity of the local microphone and the gain of the local speaker in opposite directions in response to the incoming audio control signal.

19. The program storage device of claim 12, the program of instructions executable by the machine to perform further method steps for adjusting the gain of a remote speaker within a network connection, the further method steps comprising:

transmitting outgoing speaker control signals on the network connection to adjust the gain of a remote speaker with the outgoing microphone control signals;

receiving an incoming audio control signal comprising incoming speaker control signals from the network connection and the incoming microphone control signals; and adjusting the gain of the local speaker and the sensitivity of the local microphone in response to the incoming audio control signal.

20. The program storage device of claim 19, wherein the incoming audio control signal adjusts the sensitivity of the local microphone and the gain of the local speaker in opposite directions.

* * * * *

UNITED STATES PATENT AND TRADEMARK OFFICE

CERTIFICATE OF CORRECTION

PATENT NO. : 6,504,926 B1
DATED : January 7, 2003
INVENTOR(S) : Steven D. Edelson and Ede Phang Ng It is certified that error appears in the above-identified patent and that said Letters Patent is hereby corrected as shown below:

Column 7,
Line 32, delete "p1"

Signed and Sealed this

First Day of July, 2003

JAMES E. ROGAN
*Director of the United States Patent and Trademark Office*